US007119682B1

(12) United States Patent
Fisher

(10) Patent No.: US 7,119,682 B1
(45) Date of Patent: Oct. 10, 2006

(54) FACILITY AND METHOD FOR CROWD SCREENING AND PROTECTION

(75) Inventor: David Fisher, Kiryat Ata (IL)

(73) Assignee: Rafael Armament Development Authority Ltd., Haifa (IL)

( * ) Notice: Subject to any disclaimer, the term of this patent is extended or adjusted under 35 U.S.C. 154(b) by 122 days.

(21) Appl. No.: 11/026,384

(22) Filed: Dec. 30, 2004

(30) Foreign Application Priority Data

Jan. 20, 2004 (IL) ..... 159973

(51) Int. Cl.
*E05G 5/02* (2006.01)
*G08B 13/00* (2006.01)

(52) U.S. Cl. ..... 340/550; 340/541; 109/3; 109/8; 109/32

(58) Field of Classification Search ..... 340/540, 340/541, 550; 109/3, 5–8, 38, 68; 49/41, 49/42; 86/50; 73/864.81
See application file for complete search history.

(56) References Cited

U.S. PATENT DOCUMENTS 1,826,768 A * 10/1931 Gialdini ..... 109/83
4,060,039 A * 11/1977 Lagarrigue ..... 109/3
4,063,519 A * 12/1977 Pretini ..... 109/8
4,122,783 A * 10/1978 Pretini ..... 109/3
4,586,441 A * 5/1986 Zekich ..... 109/8
5,668,342 A * 9/1997 Discher ..... 86/50
5,692,446 A * 12/1997 Becker et al. ..... 109/3
5,915,268 A * 6/1999 Linker et al. ..... 73/23.2
6,073,499 A * 6/2000 Settles ..... 73/864.81
6,354,181 B1 * 3/2002 Donovan ..... 86/50
6,484,650 B1 * 11/2002 Stomski ..... 109/6
6,507,278 B1 * 1/2003 Brunetti et al. ..... 340/541
6,724,304 B1 * 4/2004 Risi ..... 340/540
6,742,301 B1 6/2004 Schwarz
2003/0136052 A1 7/2003 De Boer

* cited by examiner

*Primary Examiner*—Jeffery Hofsass
*Assistant Examiner*—Anne V. Lai
(74) *Attorney, Agent, or Firm*—Frishauf, Holtz, Goodman & Chick, P.C.

(57) ABSTRACT

A method and a facility for the protection of a crowd from terrorists by screening each individual in search of concealed prohibited articles possibly carried by one of the individuals in the crowd. Each individual is monitored by sensors controlled by a monitoring unit while passing in single line queue over a fenced walkway and through a confinement structure containing a one-way passage control device. When a prohibited object is detected, response is provided and the passage control device is locked to detain the suspect individual in the confinement structure interior. The confinement structure is configured to deflect the blast created by an explosion initiated therein, and to prevent harm to the individuals residing on the fenced walkway.

20 Claims, 2 Drawing Sheets

FACILITY AND METHOD FOR CROWD SCREENING AND PROTECTION

The present application claims priority of Israel Patent Application No. 159973, filed Jan. 20, 2004, the priority date of which is claimed herein, and the entire disclosure of which is incorporated herein by reference.

TECHNICAL FIELD

The present invention relates to crowd screening and protection, for the detection of prohibited articles such as concealed by terrorists, and for protection against those articles, and more particularly, to a facility and a method for detecting prohibited articles, such as bombs, and for protection against bombs, especially against a suicide bomber exploding in a crowd.

BACKGROUND ART

During the last decades, a large and ever-increasing number of explosive-carrying terrorists blew themselves up among random or selected victims, often inflicting heavy casualties to their intended targets and to passers-by, and also causing severe material damage and loss of life. Existing devices and methods for the detection of explosives carried by terrorists achieved only partial success, for numerous reasons.

Nowadays, the detection of terrorists mostly relies on guards positioned at the entrance of shops, restaurants and public buildings. These guards usually scan each individual by operating hand-held devices, such as metal detectors, or make them pass through a detection gate. In addition, personal belongings, such as purses and bags are searched through.

U.S. Patent Application No. 2003/0136052 by De Boer, divulges a revolving door, comprising a rotatable partition embodied such that in, at or on the partition one or more means for the detection of inadmissible goods are provided. Furthermore, U.S. Pat. No. 6,742,301 to Schwarz also discloses a revolving door, but with a metal detection function. Both inventions are a kind of automatic detection device, but are short of dealing with an uncovered terrorist.

The presently used terrorist uncovering scheme is dangerous, since a terrorist most often blows himself up when believing he has been found out, to kill guards and crowds of queuing-up bystanders. Thereby, security personnel which have to come close to a potential suicide bomber, stands high risks, which might impair their effectiveness.

It would thus be advantageous to first detect potential malevolent individuals and then retain them secluded in a manner that will prevent harm from bystanders even if they commit suicide by detonating a bomb.

Definitions

Individual, person, or pedestrian: generic name used interchangeably to indicate a person, sometimes walking or moving in one direction to pass from one place to another.

Crowd, or people: a plurality of individuals.

Sensor: a device for reporting or for measuring a physical, biometric, chemical, or physiological condition or parameter, as well as a surveillance and monitoring apparatus.

DISCLOSURE OF THE INVENTION

It is hard to detect a terrorist amongst a crowd of individuals, such as a people converging toward the entrance of a mall, an airport, a stadium, or any entrance. Even if detected, it is still hard to distinguish at distance if the terrorist is carrying weapons and/or explosives. Finally comes the question of how to deal with such a terrorist when caught.

To overcome this difficulty, the crowd is first divided into lines, by compelling one-way passage of each one person in turn through a fenced walkway (FW). The end of the FW provides entrance into a confinement structure (CS) containing a one-way passage control device (PAC), configured for permitting passage therethrough to one individual at a time, and for being locked upon command, to confine a suspect individual in the confinement structure interior.

Both the fenced walkway and the confinement structure may accommodate one or more sensors necessary to detect hidden objects, and thereby indicate a suspect, which is then locked in the confinement structure interior for further treatment. The confinement structure (CS) is appropriately structurally reinforced to sustain and confine an explosion possibly initiated therein by a trapped terrorist, and to mitigate harm to the surroundings, while permitting the blast created by the explosion to escape via an open CS top opening, via an open CS entrance opening and via an open CS exit opening.

A facility implementing the method for crowd screening and detection of individuals carrying prohibited articles is useful for various regulation and law enforcing entities.

SUMMARY

It is an object of the present invention to provide a facility (1) and a method of implementation for crowd screening and protection, configured for monitoring a plurality of individuals walking through the facility, and for detecting prohibited articles and substances carried by an individual out of the plurality of individuals. In the facility, individuals first pass over a laterally-fenced walkway (FW) (311) having a FW entrance (315) open at a first upstream end, and a FW exit (317) open at a second downstream end of the fenced walkway, compelling individuals to walk in single line queue over the fenced walkway. Next, the individuals pass into a confinement structure (CS) (500) having a CS interior (537) separated from a CS exterior (539) by a peripheral wall (529) accommodating an open CS entrance opening (531) adjacent the FW exit, and an open CS exit opening (533). The facility is configured for permitting passage of individuals, solely from the FW entrance to the CS exit opening, via the FW exit and the CS entrance opening. There is at least one one-way passage control device (900), disposed in the CS interior, operable in a first passage mode for permitting free-passage of an individual, and in a second releasable locked mode for releasably confining a single individual at a time to the CS interior. Finally, there is a monitoring unit (MU) (700) configured for management, control, and operation of the facility, including at least one sensor (100) operative for monitoring each one individual walking through the facility, for detecting prohibited articles. The monitoring unit (700) has means for processing and for deriving results in real time from the monitoring of individuals performed by the at least one sensor, and means for commanding operation of the at least one passage control device. Thereby, the at least one passage control device is releasably locked by command when prohibited articles and substances carried by an individual are detected by the monitoring unit.

It is another object of the present invention to provide at least one sensor retained in a mode selected alone and in combination from the group of retention modes consisting of retention to the fenced walkway and retention to the confinement structure. The at least one sensor includes an array of sensors selected alone and in combination from the group of sensors consisting of sensors of the same type and sensors of different type.

It is yet another an object of the present invention to provide a monitoring unit that operates a detection procedure providing a response in real time upon detection of prohibited articles and substances carried by an individual, wherein the monitoring unit operates the locking device in operative association with the response by either one of both, providing an automatic command and by requesting the application of a manual command. The operation of the at least one monitoring unit is selected alone and in combination from the group of operative modes consisting of automatic operation and of personnel-supported operation. Furthermore, at least one monitoring unit is selected alone and in combination from the group of configurations consisting of central control and distributed control. Moreover, the at least one monitoring unit is selected alone and in combination from the group of dispositions consisting of local disposition and of remote disposition, respectively adjacent and remote from the fenced walkway and from the confinement structure. Finally, if desired, the at least one monitoring unit is configured as either one of both a single unit and a plurality of units.

It is a further object of the present invention to provide a facility with a confinement structure that has an open CS top opening (523) configured for exhaust of an explosion blast resulting from an explosion initiated in the CS interior (537), and a CS bottom (527) opposite the CS top opening, that is coupled to the CS circumferential wall (529) which is appropriately reinforced to sustain an explosion, whereby when an explosion is initiated in the CS interior, the CS bottom and the CS F wall confine the explosion while the CS entrance opening, the CS exit opening and the CS top opening allow escape of the explosion blast.

It is yet a further object of the present invention to provide a facility wherein the fenced walkway is oriented at an angle relative to an entrance direction into the CS entrance opening, whereby harm is mitigated to individuals residing on the fenced walkway when an explosion blast escapes out of the of CS entrance opening.

BRIEF DESCRIPTION OF DRAWINGS

In order to understand the invention and to see how it may be carried out in practice, embodiments including the preferred embodiment will now be described, by way of non-limiting example only, with reference to the accompanying drawings, in which like numerals and characters indicate like features and wherein.

DESCRIPTION OF PREFERRED EMBODIMENTS

Figure 1:
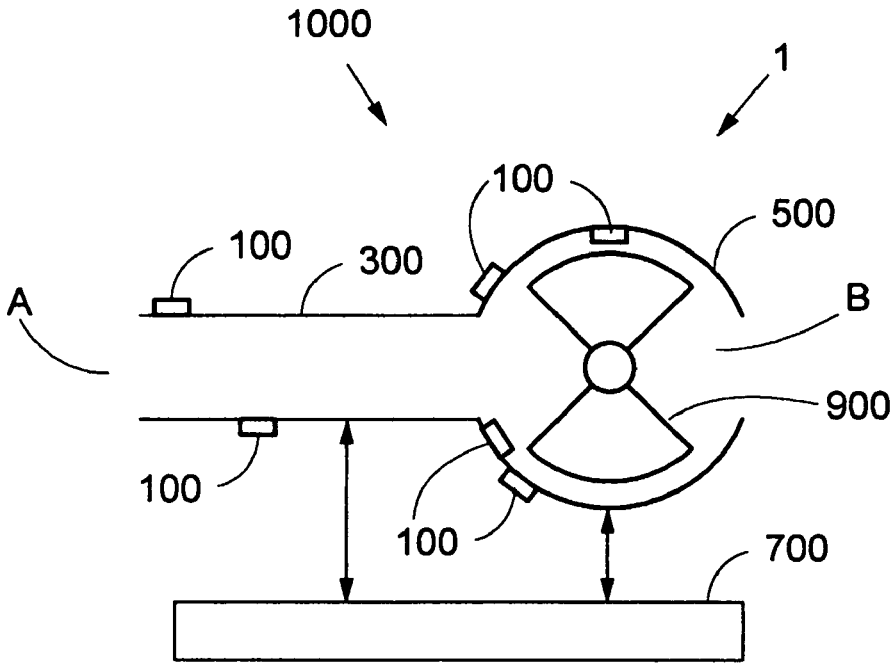
FIG. 1 is a schematic diagram illustrating the main elements of a facility for crowd screening.

With reference to FIG. 1, there is shown a block-diagram illustrating the principles of operation of a facility 1 implementing a method for crowd screening and protection designated as embodiment 1000. A confinement structure (CS) 500 coupled in continuation to a fenced walkway (FW) 300 has an upstream open entrance A and a downstream open exit B. At least the confinement structure contains a one-way passage control device (PAC) 900, such as a turnstile for example, configured for operation in a first and in a second mode. The first mode allows passage of one person at a time through the confinement structure 500. The second mode permits to releasably lock the passage control device 900 upon command, for confining an individual to the CS interior. A person may thus pass via the facility 1 starting from the open entrance A of the fenced walkway 300, and exit through the open exit B. However, if so commanded, the passage control device 900 may prevent exit out of the confinement structure 500, whereby a person is locked by the in the CS interior. A further command will unlock the passage control device 900, to release the confined person.

The fenced walkway 300 and the confinement structure 500 are equipped with one or more sensors 100, which is or are attached to either one of both or to both, for the purpose of monitoring a person walking through the facility 1. The sensors 100 are coupled to a monitoring unit (MU) 700, which receives sensor output data and derives a sensor response therefrom. It is according to the sensor response that passage control device locking is commanded or not, and that optionally, warning or alarm is given to the surroundings and/or relayed further on.

The monitoring unit 700 is configured for management, control, and operation of the facility 1, has means for processing and for deriving results in real time from the monitoring of individuals performed by the at least one sensor, and has means for commanding operation of the at least one passage control device.

Furthermore, the monitoring unit 700 is adjacent or remote from the fenced walkway 300 and of the confinement structure 500, and operates as an entirely automatic processor-driven unit, or as a unit also be staffed by trained personnel, or in mixed automatic and staff-operated mode. The monitoring unit 700 is optionally divided into interconnected subunits, residing at all the same location, either adjacent or remote from the fenced walkway 300 and the confinement structure 500, or at both adjacent and remote locations.

It is noted that communication links between the monitoring unit 700 and the sensors 100 are bi-directional, for example for communication with people crossing the facility 1.

It is thus understood that the one-way direction of passage of the crowd in the facility 1 is preferably limited to one single individual at a time the CS interior, to prevent harm to others, should an explosion be initiated in the CS interior. Many solutions permit to ascertain that only a single person at a time resides in the confinement structure.

For example, one single passage control device 900, controlled by the monitoring unit 700, may prevent the entrance of more than one individual in the confinement structure 500. Furthermore, to keep people at a distance from the confinement structure 500, a single controlled turnstile on the fenced walkway 300 suffices, when permission for an individual to proceed is given only after a preceding person has left the confinement structure 500. Evidently, many passage control devices may be used in combination, under control of the monitoring unit 700, to achieve the same result, namely of allowing but one person at a time in the CS interior.

The passage control device 900 is possibly a rotating device such as a turnstile, represented symbolically in FIGS. 2 and 3 by four quadrants: two opposite quadrants into which a person may enter to later exit, and two other opposite quadrant preventing entrance. An individual thus enters into quadrant 947, the device revolves for a quarter of a turn, and either stops for confinement or continues for another quarter of a turn, after which the person exits.

A confinement structure 500, with a rectangular or other cross-section, may possibly benefit from conventional double doors, where the entrance door and the exit door are never open simultaneously. In this example, the entrance door opens to admit an individual, then closes for either detaining the person, or the exit door opens for the person to exit while the entrance door remains closed.

Figure 2:
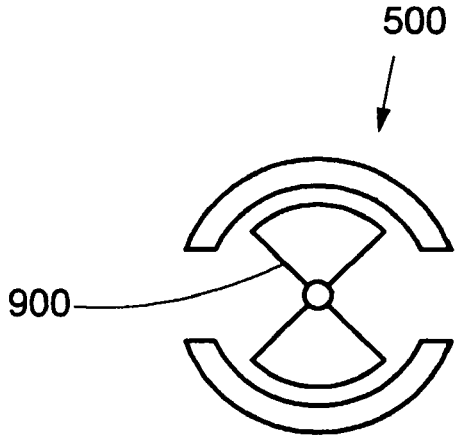
FIGS. 2 and 3 show a detail pertaining to the diagram of FIG. 1.
Figure 3:
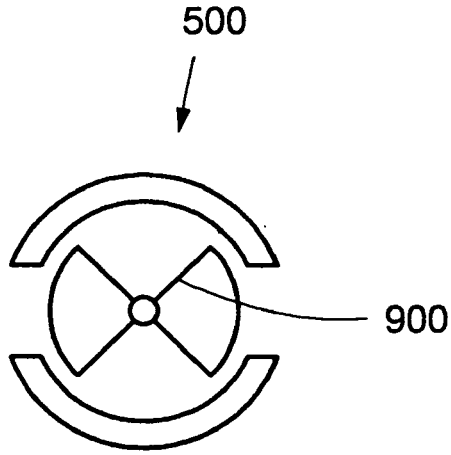

The symbolic representation of FIGS. 2 and 3 is used in the description solely to represent a one-way passage control device, even though various alternatives are well known in the art.

Figure 4:
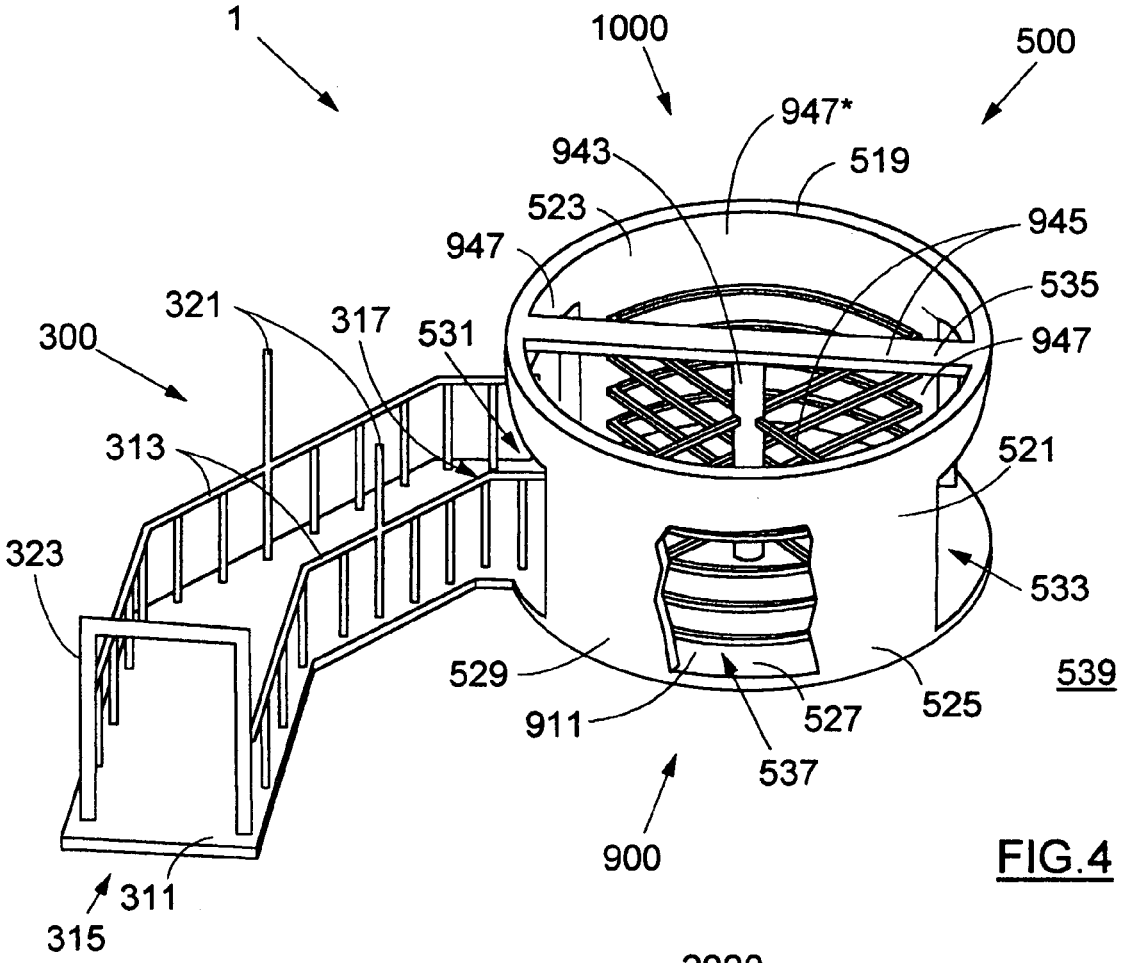
FIG. 4 is an isometric view with more details of the facility shown in FIG. 1, and FIG. 5 schematically depicts an embodiment integrating a plurality of facilities shown in FIG. 1.

FIG. 4 shows an example of a fenced walkway 300 leading to the confinement structure 500. A fenced walkway path 311, such as an elongate walkway, is delimited on each one of both lateral sides by a fence 313, to define a FW entrance 315 and a FW exit 317. The distance between both parallel fences 313 is selected to compel the pedestrians to walk in line, each one behind the other. One or more sensors 100, not shown in FIG. 4, are attached along the length of the fenced walkway 300, directly to the fence 313, to a FW pole 321, or to a frame or gate 323. The length of the fenced walkway 300 is defined as the distance between the FW entrance 315 and the FW exit 317. The longer the fenced walkway 300, the more time is available to a sensor 100 and to the monitoring unit 700 for monitoring an individual. If desired, although not shown in FIG. 4, another one-way FW PAC 900* is located at the FW entrance 315, or anywhere along the fenced walkway, to prevent people on the path 311 to exit through the entrance 315, and to allow entrance to the fenced walkway, or to a portion thereof, but when permitted, in association with the passage control device 900 in the confinement structure 500, and under control of the monitoring unit 700.

The confinement structure 500 of embodiment 1000 is implemented, for example, as a vertical straight cylindrical structure forming a tube 319, although other geometrical shapes and combination of shapes are also practical and may also be used.

The tube 519 has two opposite but co-aligned portions, namely a top portion 521 with a top opening 523 at the upper extremity, and a bottom portion 525 with a bottom end 527 normally resting on the ground. Both opposite open top opening end 523 and closed bottom end 527 delimit an enveloping wall 529 of the confinement structure 500. An appropriately sized CS open entrance opening 531, entered in the tube 519, is disposed diametrically opposite to open CS exit opening 533, also entered in the tube 519, and accommodated in the bottom portion 525, for ease of passage of pedestrians. In addition, the top portion 521 is configured to accommodate lifting means, not shown in the Figs., for facilitating moving and transportation of the confinement structure 500.

The top opening 523 is open to allow escape of an explosion blast created by an explosion initiated in the CS interior 537, but appropriately designed elements such as diametrically extending beams or a light cover are permissible, on condition of presenting but negligible resistance to the exit of the blast. It is noted that an opening is regarded as being open in the senses of allowing free passage for an explosion blast. Even when an opening is covered by a light and fragile physical cover, the opening is considered as being open, with regard to an explosion blast. The bottom portion 525 is configured to enhance reflection of the explosive blast from the bottom end 527 for exit via the top opening 523. Furthermore, the top opening 523 may accommodate one or more diametrically extending beams 535, to which a portion of a one-way passage control device 900 is coupled. Although not shown in the Figs., the top opening 523 is covered, to prevent escape therethrough, by a cover of lightweight material, or of frangible matter, and/or by a grille, but without becoming an impediment to a blast shock wave reflected from the bottom end 527 skyward.

The confinement structure 500 thus contains a one-way passage control device 900, represented for example, as a cruciform turnstile 941. A vertical pole 943 extending along the vertical axis of the tube 519, is coupled in indexed one-way rotation to the bottom end 527 and to the diametrical beam 535, with horizontal perpendicularly-extending diametrical arms 945, in spaced apart distribution along the length of pole 543, to form four rigidly separate cells 47. Each cell is thus a sector, and all sectors are equal in size if desired. It is noted that when the confinement structure 500 is not a cylindrical tube, at least the bottom portion 525 is configured to match the turnstile 941, or any other indexable one-way passage control device 900, as well as the functional requirements of passage and of confinement.

In the present configuration the turnstile 941 is indexed to rotate in registered steps of 90°, and is configured to present one cell 947 opposite the open CS entrance opening 531 with another diametrically opposite cell 947 opposite the open CS exit opening 33. Two more diametrically opposite cells 947* are inaccessible.

Two diametrically opposite cells out of the four cells 947 thus form a confinement space, each one of those cells being a sector delimited by an arc of the peripheral wall 529, and by radial extensions of the diametrical arms 945. It is noted that the arms 945 are appropriately spaced apart to prevent passage therebetween from one cell 947 to an adjacent cell, and are sized to match the interior of the tube 519, to prevent passage between the extremities of the diametrical arms 945 and the inside of the peripheral wall 529, but allow free passage to an explosion blast.

The turnstile 941 is lockable to prevent further rotation around the pole 943, thereby not only preventing passage through the confinement structure 500, but also trapping any individual in transit between the open CS entrance opening 531 and the open CS exit opening 533.

The purpose of the confinement structure 500 is to constrain and resist the effects of an explosion initiated therein, to mitigate the damage to the surroundings, and to prevent harm from crowds standing or passing outside of the confinement structure. As a built structure, the confinement structure 500 is preferably made out of heavily reinforced concrete, and is even further strengthened by locally disposed steel belts encircling the peripheral wall 529. Optionally, the confinement structure 500 is made of steel or of any other material fitting the requirements. The confinement structure 500 is strengthened to withstand an explosion occurring inside thereof, relative to a selected load of explosive initiated above the bottom end 527. If desired, that load of explosive is chosen as one possibly being carried by a person at the height of the waist, but other selections are possible. Structural analysis programs using finite element methods, simulation programs, reduced scale tests, and real-size experiments, are all helpful to determine the necessary reinforcements of the confinement structure 500. Optionally, the confinement structure 500 is made of composite materials for example.

The facility 1 consists of prefabricated elements, and is transportable from one site to another, as a complete unit. If desired, the facility 1 is erected in situ as a permanent installation.

In FIG. 4, it is shown that the FW path 311 is tangential to the confinement structure 500, so that the elongate walkway 311 is perpendicular or tangential to the mutually opposite CS entrance and exit openings, respectively 531 and 533. The fenced walkway is thus oriented at an angle relative to an entrance direction into the CS entrance opening 531. This angular configuration is selected to mitigate possible harm to people still on the FW path 311 when an explosion blasts out of the CS entrance and exit openings, respectively 531 and 533.

All the structural elements of the facility 1 of embodiment 1000, such as the fenced walkway 300, the confinement structure 500, and any passage control device 900, are able to support a variety of sensors 100. For example, sensors in view, or hidden from view, are easily attached to the fence 313, to a pole 351, or to a frame or gate 353. The confinement structure 500 itself may have sensors 100 on the CS exterior 539, the CS interior 537, and there may be sensors even on an additional entrance passage control devices possibly located at the FW entrance 315, but not shown in FIG. 4. More sensors 100 may possibly be embedded in the floor of the path 311 and in the bottom end 527, and sensors may also be located remote from the fenced walkway 300 and from the confinement structure 500.

The sensors 100 or detectors 100 may be selected from different types, such as material and substance detectors, biometric and physiological sensors, and/or a combination thereof. For example, metal, explosives and drug detectors, may be combined with body condition detectors pertaining to the corporeal reactions of an excited, frightened, or possibly drugged potential terrorist. If desired, such devices may include video and IR cameras, Nuclear Quadrupole Resonance (NQR) detectors, drug "sniffer" devices, pulse rate and body temperature sensors, pupil dilatation and eye-blinking measuring equipment, sweat discharge measurement, face recognition, and the like.

The sensors 100 are coupled to the monitoring unit 700, which records and processes sensor output data and derives sensor response data therefrom. In turn, the sensor response data is further processed to provide fused data, which increases detection reliability, and allows to rank each monitored individual with a level-of-danger factor, such as ranging, for example, from a first level being acceptable and inoffensive, a second level requiring caution, and a third level as presenting immediate danger.

The monitoring unit 700 analyzes data received from a sensor either automatically only or with the support of trained personnel.

For proper operation, the facility 1 and the method crowd for screening and protection requires adequate area delimitation, as described in detail below, to prevent passage from a first upstream area to a second downstream area, unless through the facility. A crowd desirous of crossing from the first upstream area to the second downstream area is thus compelled to pass through the fenced walkway 100, the confinement structure 500, and at least one passage control device 900. In addition, the facility 1 must be powered-on for the sensors 100 and the monitoring unit 700 to become operational before the facility is opened for use.

People wanting to cross downstream will have to form a line to enter through the FW entrance 315, one by one, and exit through the CS exit opening 533 by operating the one-way passage control device 900. Each individual will have to walk down the entire length of the fenced walkway 300, enter the confinement structure 500 via the open CS entrance opening 531, and operate the one-way passage control device 900 to egress via the open CS exit opening 533. The duration of the downstream walk through the facility 1 is proportional to the length of the fenced walkway 300 and to the speed of operation of the one-way passage control device 900, such as for example, the response time of the sensors 100, the processing speed of the monitoring unit, and the speed of rotation of the turnstile 941, which is controllably limited, if desired.

Sensors 100 mounted on the fenced walkway 300 scan each person starting even before crossing the FW entrance 315, then along the length of the fenced walkway, as well as in the confinement structure 500. The fenced walkway 300, possibly with FW poles 351 and frames 353 may be loaded with sensors 100 that are supported in full view, or hidden. The confinement structure 500 also contains sensors 100, visible or concealed, but possibly also installed on the passage control device 900 itself.

It is thus possible to track an individual from well before walking through the FW entrance 315, for the whole length of the FW path 311 downstream through the CS exit 533. The monitoring unit 700 captures the data from the sensors and after processing, decrees whether an individual is detected as being harmless, in which case he walks through the facility 1 without hindrance, or whether he is potentially dangerous, suspect, or an immediate peril, and must be stopped on the spot.

When suspect, a person may further be investigated while being locked-in and secluded inside the confinement structure 500, or after being taken away for interrogation. However, the situation may become precarious when the monitoring unit 700 blocks the at least one one-way passage control device 900 with a suspect locked in the confinement structure 500 interior: preferably, the suspect is incapacitated before he may blow himself or herself up. However, since the confinement structure 500 is configured to mitigate explosion damage, the explosion blast and possible shrapnel are deflected to exit via the top opening 523 and via the mutually opposite CS entrance and exit openings, respectively 531 and 533. Since the elongated FW path 311 is disposed at an angle to the direction of the entrance and exit openings, respectively 531 and 533, damage to by-standing people is either prevented, or at least limited to a minimum.

Figure 5:
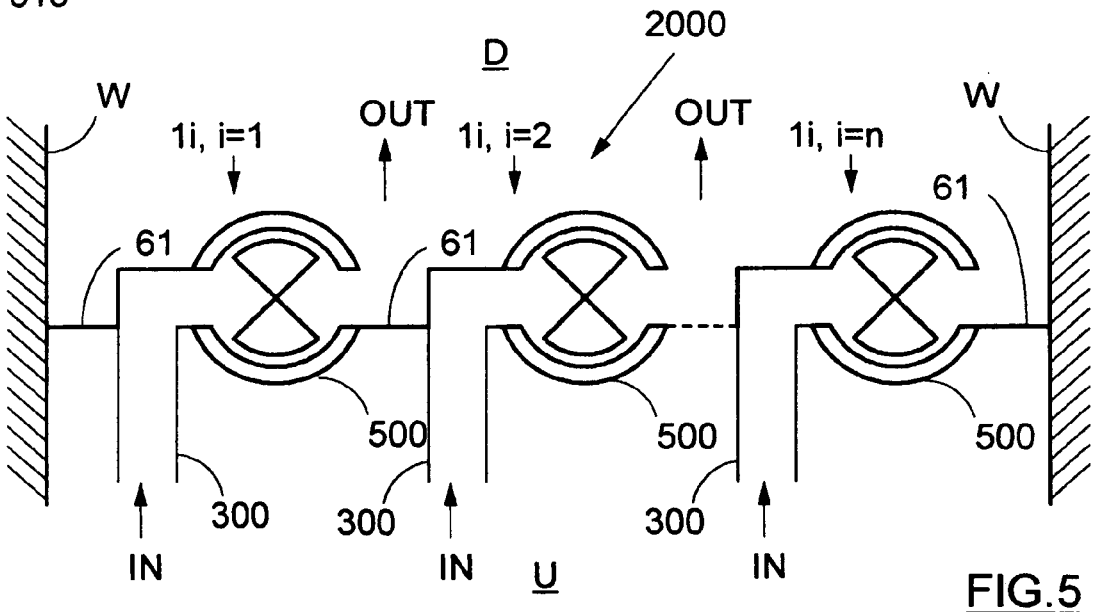

FIG. 5 schematically illustrates an embodiment 2000, as an example of how the method is used to screen the passage of large crowds by installing a line with a plurality of i single facilities 1, designated each as 1*i*, with i=1[1, 2, . . . n]. Using the same designation, each facility 1*i* is arranged in substantially parallel alignment with any other facility 1*i*, but other configurations are also possible. The plurality of facilities 1*i* in the embodiment 2000 bridge between two substantially parallel walls W, or two delimiting partitions W, perpendicular to the direction from upstream to downstream. It is assumed that the crowd is desirous to cross from the upstream area U to the downstream area D, and has therefore to follow the direction of an arrow marked IN in FIG. 5, so as to exit in the direction of an arrow designated as OUT. A barrier 61 separates between each adjacent facility 1*i*, and between the facilities 1*i* at each one of both ends of the line of facilities 1*i* and a wall W, to prevent passage from the upstream area U to a downstream area D without crossing through a facility 1*i*. With embodiment 2000, although not shown in FIG. 5, there is either one single monitoring unit 700 for all the facilities 1*i*, or more than one monitoring unit, or one monitoring unit for each group of facilities 1*i*, or with at most one monitoring unit 700 for one facility 1*i*.

Computerized simulation programs predicted the success of the real-life tested confinement structure 500 with a heavily reinforced tube 519 made of concrete, having 3 m of height, 2 m of internal diameter, and a peripheral wall 529 of 0.3 m thickness. Both the CS entrance opening 531 and the CS exit opening 533 were dimensioned as 2.1 m high and 0.9 m wide. The charge of explosive was detonated at the height of 1 m above the bottom end 527 of the confinement structure 500, and consisted of a load of 10 kg of TNT and 5 kg of shrapnel. The tube 319 was proven successful in limiting the chances of death to less then 50% at a distance of 0.5 m outside of the confinement structure 500. Evidently, the dimensions of the confinement structure 500 are easily adapted to desired requirements.

As to industrial applicability, the hereinabove description of the facility 1 explicitly indicates implementation and exploitation details. Evidently, the method and facility 1 are applicable to the detection of drugs, thus applicable against smuggling, and are also useful for other custom enforcement purposes, as well as for other regulatory entities, or law enforcing authorities.

It will be appreciated by persons skilled in the art, that the present invention is not limited to what has been particularly shown and described hereinabove. For example, the fenced walkway 500 may adopt any shape besides being linear, and the confinement structure 500 may have a cross-section other than circular, or have various different cross-sections. Rather, the scope of the present invention is defined by the appended claims and includes both combinations and sub-combinations of the various features described hereinabove as well as variations and modifications thereof which would occur to persons skilled in the art upon reading the foregoing description.

The invention claimed is:

1. A facility for crowd screening and protection configured for monitoring a plurality of individuals walking through the facility, and for detecting prohibited articles and substances carried by an individual of the plurality of individuals, comprising:

a laterally-fenced walkway (FW) having an FW entrance open at a first upstream end, and an FW exit open at a second downstream end of the fenced walkway, compelling individuals to walk in single line queue over the fenced walkway, a confinement structure (CS) having a CS interior separated from a CS exterior by a peripheral wall accommodating an open CS entrance opening adjacent the FW exit, and an open CS exit opening, the facility being configured for permitting passage of individuals, solely from the FW entrance to the CS exit opening, via the FW exit and the CS entrance opening, at least one one-way passage control device, disposed in the CS interior, operable in a first passage mode for permitting free-passage of an individual, and in a second releasable locked mode for releasably confining a single individual at a time to the CS interior, a monitoring unit (MU) configured for management, control, and operation of the facility, including:

at least one sensor operative which monitors each individual passing through the facility, to detect prohibited articles, a processing device which derives results in real time from the monitoring of individuals performed by the at least one sensor, and a controller which controls operation of the at least one passage control device, whereby the at least one passage control device is releasably locked by command when prohibited articles and substances carried by an individual are detected by the monitoring unit, the confinement structure further comprising:

an open CS top opening configured in the confinement structure for exhaust of an explosion blast resulting from an explosion initiated in the CS interior, and a CS bottom opposite the CS top opening, and coupled to the CS peripheral wall which is appropriately reinforced to sustain an explosion, whereby when an explosion is initiated in the CS interior, the CS bottom and the CS peripheral wall confine the explosion while the CS entrance opening, the CS exit opening, and the CS top opening allow escape of the explosion blast, and whereby damage from the explosion to the surroundings is mitigated.

2. The facility according to claim 1, wherein:

the confinement structure is configured to mitigate damage to the surroundings and to prevent harm from crowds standing and passing outside of the confinement structure.

3. The facility according to claim 1, wherein:

the confinement structure comprises heavily reinforced concrete, and is strengthened by locally disposed steel belts.

4. The facility according to claim 1, wherein:

the fenced walkway is oriented at an angle relative to an entrance direction into the CS entrance opening, whereby harm from the explosion to individuals residing on the fenced walkway when the explosion blast escapes out of the of CS entrance opening is mitigated.

5. The facility according to claim 1, wherein:

the confinement structure comprises composite materials.

6. The facility according to claim 1, wherein:

the confinement structure is transportable from one site to another remote site as a complete unit.

7. The facility according to claim 1, wherein:

the confinement structure is configured to accommodate lifting means for facilitating movement and transportation of the facility.

8. The facility according to claim 1, wherein:

the confinement structure includes a top portion having a top opening which is opposite and co-aligned with a bottom portion having a bottom end, and the bottom portion is configured to enhance reflection of the explosion blast from the bottom end for exit via the top opening.

9. The facility according to claim 1, wherein:

the confinement structure includes a top portion having a top opening which is opposite and co-aligned with a bottom portion having a bottom end, the bottom portion is configured to enhance reflection of the explosion blast from the bottom end for exit via the top opening, and the explosion blast and any resulting shrapnel are deflected to exit via the top opening.

10. The facility according to claim 1, wherein:

the confinement structure comprises prefabricated elements.

11. A method for protecting a crowd from harm caused by an explosion by employing a facility for screening individuals out of the crowd to detect prohibited articles and substances carried by an individual, comprising the steps of:

providing a confinement structure (CS) having a CS interior separated from a CS exterior by a circumferential wall accommodating an open CS entrance opening and an open CS exit opening, disposing a laterally-fenced walkway (FW) having a FW entrance open at a first upstream end, and a FW exit open at a second downstream end of the fenced walkway, compelling individuals to walk in single line queue over the fenced walkway, with the FW exit being operatively coupled to the open CS exit opening, and the facility being configured for permitting passage of individuals, solely from the FW entrance to the CS exit opening, via the FW exit and the CS entrance opening, disposing at least one one-way passage control device in the CS interior, operable in a first passage mode for permitting free-passage of an individual, and in a second releasable locked mode for releasably confining a single individual at a time to the CS interior, operating a monitoring unit (MU) configured for management, control, and operation of the facility, including:

at least one sensor which monitors each one individual passing through the facility, to detect prohibited articles, a processing device which derives results in real time from the monitoring of individuals performed by the at least one sensor, and a controller which controls operation of the at least one passage control device, whereby the at least one passage control device is releasably locked by command when prohibited articles and substances carried by an individual are detected by the monitoring unit, the method comprising the steps of:

providing the confinement structure with an open CS top opening configured for exhaust of an explosion blast resulting from an explosion initiated in the CS interior, and disposing a CS bottom opposite the CS top opening, and coupled to the CS peripheral wall which is appropriately reinforced to sustain an explosion, whereby when an explosion is initiated in the CS interior, the CS bottom and the CS peripheral wall confine the explosion while the CS entrance opening, the CS exit opening, and the CS top opening allow escape of the explosion blast, whereby damage from the explosion to the crowd and to the surroundings is mitigated.

12. The method according to claim 11, further comprising the step of:

configuring the confinement structure to mitigate damage to the surroundings and to prevent harm from crowds standing and passing outside of the confinement structure.

13. The method according to claim 11, further comprising the step of:

building the confinement structure with heavily reinforced concrete, and strengthening by locally disposed steel belts.

14. The method according to claim 11, further comprising the step of:

orienting the fenced walkway at an angle relative to an entrance direction into the CS entrance opening, whereby harm from the explosion is mitigated to individuals residing on the fenced walkway when the explosion blast escapes out of the of CS entrance opening.

15. The method according to claim 11, further comprising the step of:

building the confinement structure with composite materials.

16. The method according to claim 11, further comprising the step of:

building the confinement structure such that it is transportable from one site to another remote site as a complete unit.

17. The method according to claim 11, further comprising the step of:

configuring the confinement structure to accommodate lifting means for facilitating movement and transportation.

18. The method according to claim 11, further comprising the step of:

configuring the confinement structure to include a top portion with a top opening which is opposite and co-aligned with a bottom portion having a bottom end, and configuring the bottom portion to enhance reflection of the explosion blast from the bottom end for exit via the top opening.

19. The method according to claim 11, further comprising the steps of:

configuring the confinement structure to include a top portion with a top opening which is opposite and co-aligned with a bottom portion having a bottom end, configuring the bottom portion to enhance reflection of the explosion blast from the bottom end for exit via the top opening, and deflecting the explosion blast and any resulting shrapnel so as to exit via the top opening.

20. The method according to claim 11, further comprising the step of:

fabricating the confinement structure with prefabricated elements.

* * * * *